US011311441B2

(12) United States Patent
Thompson

(10) Patent No.: US 11,311,441 B2
(45) Date of Patent: Apr. 26, 2022

(54) ADJUSTABLE PORTABLE FOOT ELEVATOR

(71) Applicant: Gerald Thompson, Jackson, MS (US)

(72) Inventor: Gerald Thompson, Jackson, MS (US)

( * ) Notice: Subject to any disclaimer, the term of this patent is extended or adjusted under 35 U.S.C. 154(b) by 506 days.

(21) Appl. No.: 15/205,072

(22) Filed: Jul. 8, 2016

(65) Prior Publication Data

US 2017/0056271 A1 Mar. 2, 2017

Related U.S. Application Data

(60) Provisional application No. 62/210,748, filed on Aug. 27, 2015.

(51) Int. Cl.
*A61G 13/12* (2006.01)

(52) U.S. Cl.
CPC ..... *A61G 13/125* (2013.01)

(58) Field of Classification Search
CPC ..... A47C 7/50–506; A47C 16/02–025; A47C 7/52; A47C 16/00; A47C 16/025; A47C 27/142; A47C 20/021; A47C 9/00–105; A47C 3/18–40; A47C 15/004; A47C 12/00; A47C 12/02; A61G 13/125; A61G 13/1245; A61G 7/057; A61G 7/05723; A61G 15/105; A61G 15/12; A61G 13/12; A61G 13/1205; A61G 13/126; A61G 13/1275; A61G 13/128; A61G 13/1295; A47B 3/00; A47B 3/091; A47B 3/0911; A47B 3/0913; A47B 3/14; A61H 3/00; A61H 2003/005
USPC ..... D6/349, 353, 360, 716.16; 297/452.22, 297/423.45, 451.4, 451.5, 452.23, 452.26; 5/630, 648, 649, 651
See application file for complete search history.

(56) References Cited

U.S. PATENT DOCUMENTS 3,633,967 A * 1/1972 Timmins ..... A61F 2/60 297/423.45
4,183,579 A * 1/1980 Gonzalez y. Rojas ..... A47C 9/025 248/171
5,375,909 A * 12/1994 Lee ..... A47C 12/02 248/157

(Continued)

OTHER PUBLICATIONS

Friction and Friction Coefficients, The Engineering ToolBox, https://www.engineeringtoolbox.com/friction-coefficients-d_778.html.*

(Continued)

*Primary Examiner* — Alireza Nia
*Assistant Examiner* — Michelle J Lee
(74) *Attorney, Agent, or Firm* — Argus Intellectual Enterprise; Daniel Enea; Jordan Sworen

(57) ABSTRACT

An adjustable portable foot elevator. The adjustable portable foot elevator includes a base having an upper surface and lower surface, a plurality of support legs extending from the lower surface, a first vertical rod disposed on the upper surface, and a second vertical rod slidably engaged with the first vertical rod, wherein the second vertical rod can be locked in place via a locking mechanism. A footrest is disposed on the upper end of the second vertical rod. A cushion is disposed on the footrest, wherein the cushion is configured to support a foot thereon. The adjustable portable foot elevator provides a portable footrest that may be raised or lowered to maintain a foot at a desired elevated position for optimal comfort.

11 Claims, 3 Drawing Sheets

(56) References Cited

U.S. PATENT DOCUMENTS

| | | | | |
|---|---|---|---|---|
| 6,030,045 | A * | 2/2000 | Hoshino | A47C 9/08 297/461 |
| 6,935,697 | B2 | 8/2005 | Conlon et al. | |
| 6,935,992 | B2 | 8/2005 | Gehrke | |
| 7,669,934 | B1 | 3/2010 | Cline | |
| 8,408,652 | B1 | 4/2013 | Mobley, Sr. | |
| 8,616,652 | B1 | 12/2013 | Wells | |
| 9,681,754 | B2 * | 6/2017 | Avery | A47C 9/105 |
| 2002/0163231 | A1 * | 11/2002 | Hoshino | A47C 7/029 297/195.1 |

OTHER PUBLICATIONS

Friction and Friction Coefficients, The Engineering Toolbox, https://www.engineeringtoolbox.com/friction-coefficients-d_778.html (Year: 2004).*

* cited by examiner

ADJUSTABLE PORTABLE FOOT ELEVATOR

CROSS REFERENCE TO RELATED APPLICATIONS

This application claims the benefit of U.S. Provisional Application No. 62/210,748 filed on Aug. 27, 2015. The above identified patent application is herein incorporated by reference in its entirety to provide continuity of disclosure.

BACKGROUND OF THE INVENTION

The present invention relates to limb support devices. More specifically, the present invention provides an adjustable portable foot elevator for comfortably supporting an individual's foot in an elevated position.

Many medical procedures performed on the foot, ankle, knee, or other part of the leg require long recovery periods. It is often recommended that individuals elevate the foot in a raised position during recovery. This reduces swelling of the injured area and assists with the healing process. It can be difficult to elevate a foot in a raised position with an ineffective support. For examples, some individuals utilize a stack of pillows to elevate an injured foot. However, the foot is prone to slide off of the pillows, which may cause additional injury.

Individuals with lower back pain may also benefit from maintaining their leg in a raised position. However, it can be difficult to determine an exact elevation at which to maintain the foot for optimal comfort. The exact position may change over time depending on other factors such as the location and intensity of the pain experienced. In order to address these concerns, the present invention provides a vertically adjustable portable foot elevator having a cushion with a recessed portion configured to receive the heel portion of a foot.

Devices have been disclosed in the prior art that relate to limb support devices. These include devices that have been patented that generally relate to foot and limb supports, such as U.S. Pat. Nos. 7,669,934, 8,408,652, 8,616,652, 6,935,697, and 6,935,992.

These prior art devices have several known drawbacks. These devices fail to provide an adjustable foot rest for supporting a single foot wherein a recessed portion of the foot rest receives the heel portion of the foot. Further, the prior art devices fail to provide a planar base having a plurality of legs extending downward therefrom. There is a need in the art for an adjustable foot elevator which is portable so that an individual may elevate the foot in different locations and sitting positions.

In light of the devices disclosed in the prior art, it is submitted that the present invention substantially diverges in design elements from the prior art and consequently it is clear that there is a need in the art for an improvement to existing foot support devices. In this regard the instant invention substantially fulfills these needs by providing an adjustable portable foot elevator.

SUMMARY OF THE INVENTION

In view of the foregoing disadvantages inherent in the known types of foot supports now present in the prior art, the present invention provides an adjustable portable foot elevator wherein the same can be utilized for providing convenience for the user when supporting a foot in an elevated position. The adjustable portable foot elevator includes a base having an upper surface and a lower surface, a first vertical rod having a first end and a second end, the first end of the first vertical rod connected to the upper surface of the base, the first vertical rod having an interior volume. A second vertical rod having an upper end and a lower end is disposed within the interior volume of the first vertical rod in sliding engagement therewith. A locking mechanism is disposed on the first vertical rod, wherein the locking mechanism is configured to maintain the second vertical rod in a fixed position within the interior volume of the first vertical rod. A footrest is disposed on the upper end of the second vertical rod. A cushion is disposed on the footrest, wherein the cushion has an upper surface configured to support a foot thereon.

One object of the present invention is to provide an adjustable portable foot elevator having all of the advantages of prior art foot supports and none of the disadvantages.

Another object of the present invention is to provide adjustable portable foot elevator having a planar base and a plurality of legs extending downward from the planar base.

A further object of the present invention is to provide an adjustable portable foot elevator having a cushion with a recessed portion configured to receive the heel portion of a foot therein.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
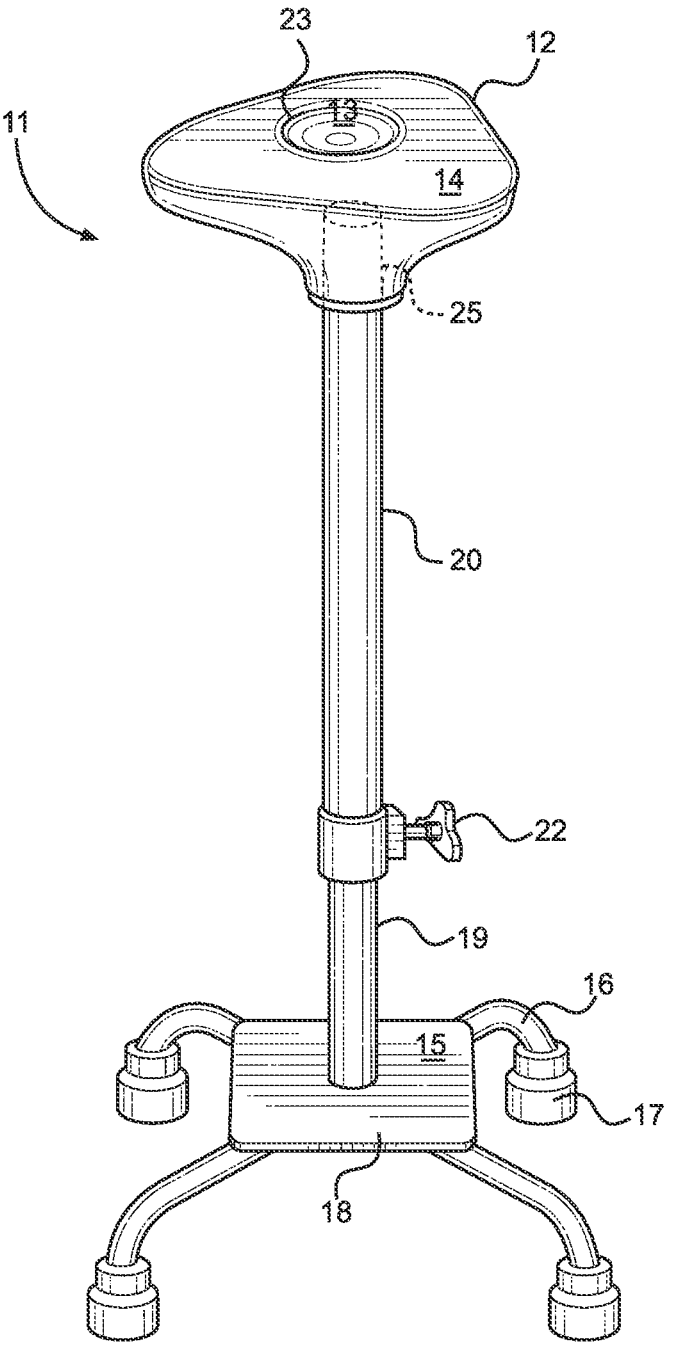
FIG. 1 shows a perspective view of one embodiment of an adjustable portable foot elevator according to the present invention.

Reference is made herein to the attached drawings. Like reference numerals are used throughout the drawings to depict like or similar elements of adjustable portable foot elevator. For the purposes of presenting a brief and clear description of the present invention, the preferred embodiment will be discussed as used for supporting a foot in a raised position. The figures are intended for representative purposes only and should not be considered to be limiting in any respect.

Referring now to FIG. 1, there is shown a perspective view of one embodiment of an adjustable portable foot elevator according to the present invention. The adjustable portable foot elevator 11 generally includes a base 18 having an upper surface 15 and a lower surface (not visible). The base 18 is preferably planar. A first vertical rod 19 is disposed on the upper surface 15 of the base 18. The first vertical rod 19 has an interior volume. A second vertical rod 20 having an upper end 21 is disposed within the interior volume of the first vertical rod 19 in sliding engagement therewith.

A plurality of support legs 16 extend downward from the base 18 in a direction opposing the upper end 21 of the second vertical rod 20. In the illustrated embodiment, four support legs 15 are provided. The support legs 16 each comprise a gripping foot 17 thereon, wherein the gripping foot 17 contacts the floor and prevents slippage of the adjustable portable foot elevator 11. The gripping foot 17 is preferably made from rubber or from another high-friction material having a coefficient of friction greater than one, which helps to prevent the user from accidentally moving the adjustable portable foot elevator 11 along the ground during use.

A locking mechanism 22 is disposed on the first vertical rod 19 and is configured to maintain the second vertical rod 20 at a fixed position within the interior volume of the first vertical rod. In the illustrated embodiment, the locking mechanism 22 comprises a set screw configured to frictionally engage with the second vertical rod 20 in order to prevent movement thereof. Alternate embodiments may include alternate locking mechanisms 22 such as a rack and pin system. In this way, the first vertical rod 19 and second vertical rod 20 combine to provide telescoping properties and provide height adjustability to the adjustable portable foot elevator 11.

A footrest 14 is disposed on the upper end 21 of the second vertical rod 20. In a preferred embodiment, the footrest 14 is removably secured to the second vertical rod 20 via a threaded connection therewith. A cushion 12 is disposed on the footrest 14. The cushion 12 comprises a recessed surface 13 having perimeter 23. In the illustrated embodiment the perimeter 23 is circular. The recessed surface 13 is configured to receive the heel portion of a foot therein. The perimeter 23 provides lateral support to the foot supported by the recessed surface 13.

Figure 2:
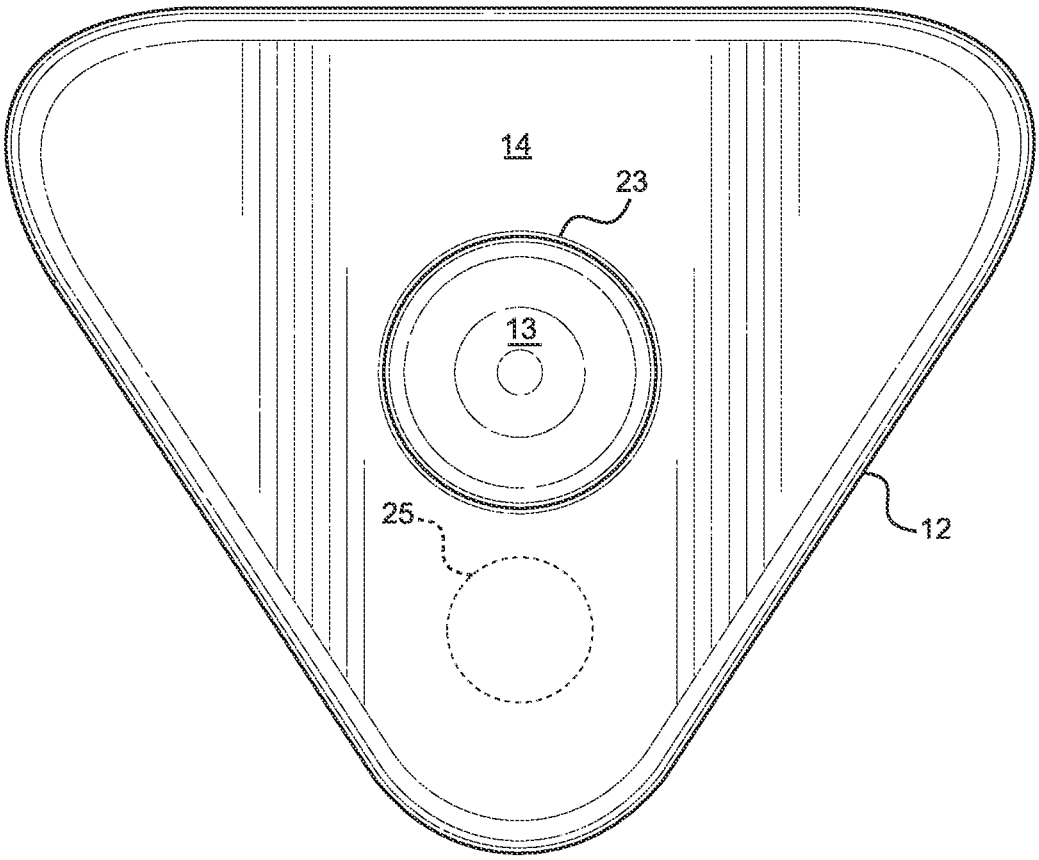
FIG. 2 shows a perspective view of the footrest portion of one embodiment of an adjustable portable foot elevator according to the present invention.

Referring now to FIG. 2, there is shown a perspective view of the footrest portion of one embodiment of an adjustable portable foot elevator according to the present invention. The footrest 14 comprises an aperture 25 configured to receive the upper portion of the second vertical rod therein. The aperture 25 is preferably threaded in order to provide a secure, threaded connection with the upper portion of the second vertical rod. The aperture 25 may be spaced a particular distance from the recessed surface 13 and perimeter 23 thereof, or the aperture 25 may be aligned beneath the recessed surface 13.

In an alternate embodiment, the cushion 12 may include a removable fabric cover thereon. The removable fabric cover is be removably secured to the cushion 12 via a zipper or other suitable fastener and is preferably machine washable. The removable fabric may comprise leather, cloth, microfiber, or any other suitable fabric that provides comfort to the user.

Figure 3:
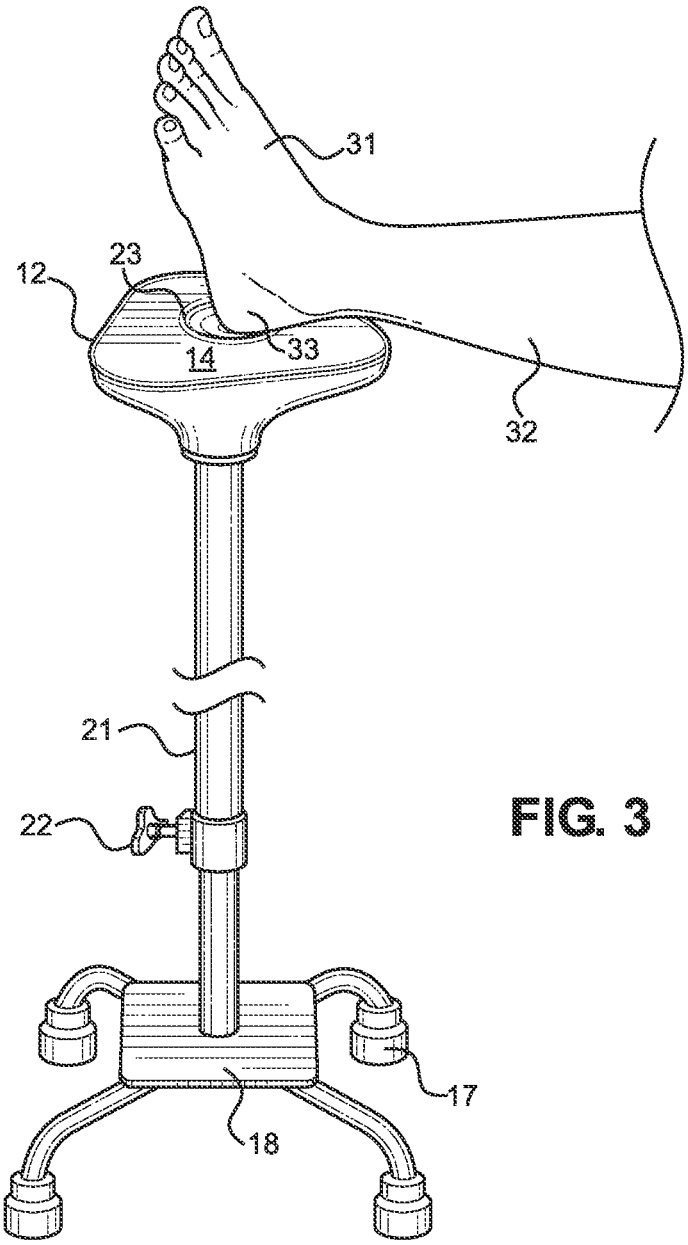
FIG. 3 shows a perspective view of one embodiment adjustable portable foot elevator according to the present invention in use to support a foot.

Referring now to FIG. 3, there is shown a perspective view of one embodiment of an adjustable portable foot elevator according to the present invention in use to support a foot. The adjustable portable foot elevator is shown supporting a leg 32 and foot 31 in a raised position on the footrest 14. The user has locked the locking mechanism 22 to securing the second vertical rod 21 at a comfortable height. The heel 33 of the foot 31 is supported within the recessed portion 13 and is laterally supported by the perimeter 23. The cushion 12 provides additional support to the portions of the foot 31 not resting within the recessed portion. In use, the base 18 provides stability for the adjustable foot support and the gripper feet 17 prevent lateral movement thereof, ensure a stable platform for the user when elevating their foot. Alternate embodiments of the adjustable portable foot elevator may include a cushion 12 having a planar upper surface with no recessed portion, wherein the cushion 12 is made from a material configured to deform and contour to the user's foot when placed thereon.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable portable foot elevator comprising:

a first vertical rod in a telescopic arrangement with a second vertical rod, wherein the first rod extends directly from a base, and a footrest is disposed at an upper end of the second vertical rod;

wherein the first vertical rod and the second vertical rod are axially aligned and configured for sliding engagement to adjust a height of the footrest;

wherein the first vertical rod extends in a perpendicular orientation from the base such that the first vertical rod and the second vertical rod are always in the perpendicular orientation to the base;

a locking mechanism configured to maintain the second vertical rod in a fixed position relative to the first vertical rod;

a cushion removably affixed on the footrest, wherein the cushion is configured to support a foot thereon;

wherein the cushion comprises a planar upper surface encircling a single recessed portion, the single recessed portion is disposed centrally and sized to receive a heel portion of the foot thereon;

the single recessed portion having a circular perimeter defining the boundary thereof, wherein an interior face of the single recessed portion is configured to laterally support the foot received therein;

the footrest having a threaded connection configured for selective engagement with the second vertical rod on a side opposite the planar upper surface;

the threaded connection extending along on a first vertical axis and the single recessed portion disposed on a second vertical axis, wherein the first vertical axis extends along a first end and a second end of the second vertical rod, wherein the second vertical axis extends from a lowermost region of the single recessed portion to an open end of the single recessed portion;

wherein the first vertical axis and the second vertical axis are parallel and offset from each other;

wherein the single recessed portion is disposed centrally relative to a perimeter of the cushion and central from each vertex of the cushion, and wherein the threaded connection is disposed offset therefrom;

wherein the planar upper surface encircling the single recessed portion extends entirely therearound and until meeting the entire perimeter of the cushion.

2. The adjustable portable foot elevator of claim 1, wherein the base further comprises a plurality of support legs disposed on the lower surface thereof, the plurality of support legs configured to support the base on a ground.

3. The adjustable portable foot elevator of claim 2, wherein each of the plurality of support legs has a ground-engaging gripping foot, and wherein the ground engaging gripping foot comprises a high-friction material.

4. The adjustable portable foot elevator of claim 3, wherein the base comprises a horizontally disposed flat plate, wherein the first vertical rod is affixed and terminates at a central portion of the base, wherein the plurality of support legs extends from four sides thereof, such that the plurality of support legs extend between the base and a ground surface.

5. The adjustable portable foot elevator of claim 4, wherein the locking mechanism is positioned intermediate the base and the cushion.

6. The adjustable portable foot elevator of claim 5, wherein the locking mechanism is a set screw configured to frictionally engage with the second vertical rod in order to prevent movement thereof.

7. The adjustable portable foot elevator of claim 6, wherein the side opposite the planar upper surface of the cushion projects toward the base and encloses the threaded connection and an upper end of the second vertical rod when secured there together, such that the threaded connection is not visible from a side view.

8. The adjustable portable foot elevator of claim 7, wherein:

the cushion forms a first overhang region that projects radially from the threaded connection to the perimeter of the cushion, wherein the single recessed portion is disposed between the threaded connection and a linear edge of the perimeter and disposed entirely on the first overhanging region.

9. The adjustable portable foot elevator of claim 6, wherein the set screw is oriented perpendicular to the first vertical axis such that rotation thereof causes linear movement towards and away from the first vertical axis.

10. The adjustable portable foot elevator of claim 3, wherein a coefficient of friction of the high friction material is greater than one.

11. The adjustable portable foot elevator of claim 1, wherein:

the cushion forms a first overhang region and a second overhang region, wherein each overhang region projects radially from the threaded connection to the perimeter and the recess disposed on the first overhanging region;

wherein the first overhanging region terminates at a maximum distance further from the threaded connection than the second overhanging region.

* * * * *